US009022756B2

(12) United States Patent
Oh et al.

(10) Patent No.: US 9,022,756 B2
(45) Date of Patent: May 5, 2015

(54) SCROLL COMPRESSOR

(75) Inventors: Hae-Jin Oh, Changwon (KR); Ki-Won Park, Changwon (KR)

(73) Assignee: LG Electronics Inc., Seoul (KR)

( * ) Notice: Subject to any disclaimer, the term of this patent is extended or adjusted under 35 U.S.C. 154(b) by 961 days.

(21) Appl. No.: 12/935,777

(22) PCT Filed: Feb. 27, 2009

(86) PCT No.: PCT/KR2009/000975

§ 371 (c)(1),
(2), (4) Date: Sep. 30, 2010

(87) PCT Pub. No.: WO2009/123400

PCT Pub. Date: Oct. 8, 2009

(65) Prior Publication Data

US 2011/0027115 A1 Feb. 3, 2011

(30) Foreign Application Priority Data

Apr. 4, 2008 (KR) ..... 10-2008-0031802

(51) Int. Cl.

| | |
|---|---|
| ***F01C 1/02*** | (2006.01) |
| ***F01C 20/24*** | (2006.01) |
| ***F04C 29/06*** | (2006.01) |
| *F04C 18/02* | (2006.01) |

(52) U.S. Cl.

CPC ..... *F04C 29/06* (2013.01); *F04C 18/0215* (2013.01); *F04C 2250/102* (2013.01)

(58) Field of Classification Search

CPC .. F04C 29/061; F04C 29/065; F04B 39/0055; F16L 55/041

USPC ..... 418/55.2, 55.1, 2, 181, 55, 1

See application file for complete search history.

(56) References Cited

U.S. PATENT DOCUMENTS

| | | | | |
|---|---|---|---|---|
| 5,137,437 | A * | 8/1992 | Machida et al. | 418/55.1 |
| 5,674,061 | A * | 10/1997 | Motegi et al. | 418/55.1 |
| 7,837,452 | B2 * | 11/2010 | Ignatiev et al. | 418/55.5 |
| 2004/0136851 | A1 | 7/2004 | Tarng et al. | 417/507 |

(Continued)

FOREIGN PATENT DOCUMENTS

| | | |
|---|---|---|
| CN | 1108358 A | 9/1995 |
| CN | 1769708 A | 5/2006 |

(Continued)

OTHER PUBLICATIONS

International Search Report issued in PCT/KR2009/000975 dated Oct. 5, 2009.

(Continued)

*Primary Examiner* — Kenneth Bomberg
*Assistant Examiner* — Anthony Ayala Delgado
(74) *Attorney, Agent, or Firm* — Ked & Associates, LLP

(57) ABSTRACT

A scroll compressor is provided with a buffer portion (113*b*) having an increased diameter at an intermediate part of a discharge port (113). A refrigerant discharged from compression chambers (p) is introduced into the buffer portion (113*b*), and temporarily stays thereat. Then, the refrigerant is discharged to a discharge plenum (150), thereby reducing a pulsating pressure. Accordingly, noise occurring when the refrigerant discharged from the compression chambers (p) collides with the discharge plenum (150) is reduced, thereby greatly reducing noise of the scroll compressor.

9 Claims, 4 Drawing Sheets

(56) References Cited

U.S. PATENT DOCUMENTS

| | | | | |
|---|---|---|---|---|
| 2007/0092390 | A1* | 4/2007 | Ignatiev et al. | 418/55.5 |
| 2009/0218164 | A1* | 9/2009 | Lucas et al. | 181/249 |

FOREIGN PATENT DOCUMENTS

| | | | |
|---|---|---|---|
| CN | 1896540 | A | 1/2007 |
| GB | 2 299 136 | | 9/1996 |
| JP | 05-005484 | | 1/1993 |
| JP | H08-061260 | A | 3/1996 |
| JP | 08-319963 | | 12/1996 |
| KR | 10-2000-0056524 | A | 9/2000 |
| KR | 10-2004-0097811 | A | 11/2004 |
| KR | 10-2004-0106729 | | 12/2004 |

OTHER PUBLICATIONS

Korean Office Action dated Feb. 26, 2014.
Korean Office Action dated Sep. 13, 2013 issued in Application No. 10-2008-0031802.
Chinese Office Action dated Oct. 10, 2013 issued in Application No. 2009890112073.7 (with English translation).

* cited by examiner

SCROLL COMPRESSOR

TECHNICAL FIELD

The present invention relates to a scroll compressor, and more particularly, to a scroll compressor capable of reducing noise occurring when a refrigerant is discharged out.

BACKGROUND ART

Generally, a compressor is a device for converting mechanical energy into compression energy of a compression fluid. The compressor may be divided into a reciprocating compressor, a rotary compressor, a vane compressor, and a scroll compressor according to a method for compressing a fluid.

The scroll compressor is provided with a driving motor for generating a driving force in a hermetic casing, and a compression unit for compressing a refrigerant of a compression fluid by receiving the driving force generated from the driving motor.

The compression unit is composed of a fixed scroll and an orbiting scroll. The fixed scroll is provided with a fixed wrap and is fixed to the casing, whereas the orbiting scroll is provided with an orbiting wrap engaged with the fixed wrap and performs an orbiting motion. The fixed wrap and the orbiting wrap are engaged with each other with a phase difference of 180° and are formed in one involute curved based on the same radius.

The orbiting scroll performs an orbiting motion with respect to the fixed scroll as the orbiting wrap thereof is engaged with the fixed wrap of the fixed scroll, thereby forming one pair of compression chambers. As the compression chambers move towards the center while the orbiting scroll performs an orbiting motion, an entire volume of the compression chambers is decreased to consecutively suck, compress, and discharge a refrigerant.

DISCLOSURE OF INVENTION

Technical Problem

However, in the conventional scroll compressor, since a discharge port disposed at the fixed scroll is linearly formed, a refrigerant finally discharged from the compression chamber has a discharge pressure equal to the initial discharge pressure. Accordingly, the refrigerant discharged from the compression chamber collides with the casing with a high strength, thereby increasing noise of the scroll compressor.

Technical Solution

Therefore, it is an object of the present invention to provide a scroll compressor capable of reducing noise occurring when a refrigerant discharged from a discharge port of a fixed scroll collides with a casing, by lowering a discharge pressure of the refrigerant by forming a buffer space near the discharge port.

To achieve these and other advantages and in accordance with the purpose of the present invention, as embodied and broadly described herein, there is provided a scroll compressor, comprising: a fixed scroll having a fixed wrap; and an orbiting scroll having an orbiting wrap, wherein the fixed scroll and the orbiting scroll form compression chambers having a decreased volume as they consecutively move toward a center of the scroll compressor by being engaged with each other, wherein the fixed scroll is provided with a discharge port through which a refrigerant compressed in the compression chambers is discharged out, and wherein the discharge port is implemented to have one or more components having different inner diameters between an entrance portion and an exit portion.

Advantageous Effects

The scroll compressor of the present invention has the following advantages.

Since a buffer portion having an increased diameter is further provided at an intermediate part of the discharge port, a refrigerant discharged from the compression chamber is introduced into the buffer portion, and then is temporarily stored. As the stored refrigerant is discharged to a discharge plenum, a pulsating pressure is reduced. Accordingly, noise occurring when the refrigerant discharged from the compression chamber collides with the discharge plenum is reduced, thereby greatly reducing noise from the scroll compressor.

BEST MODE FOR CARRYING OUT THE INVENTION

Reference will now be made in detail to the preferred embodiments of the present invention, examples of which are illustrated in the accompanying drawings.

Hereinafter, a scroll compressor according to the present invention will be explained in more detail with reference to the attached drawings.

Figure 1:
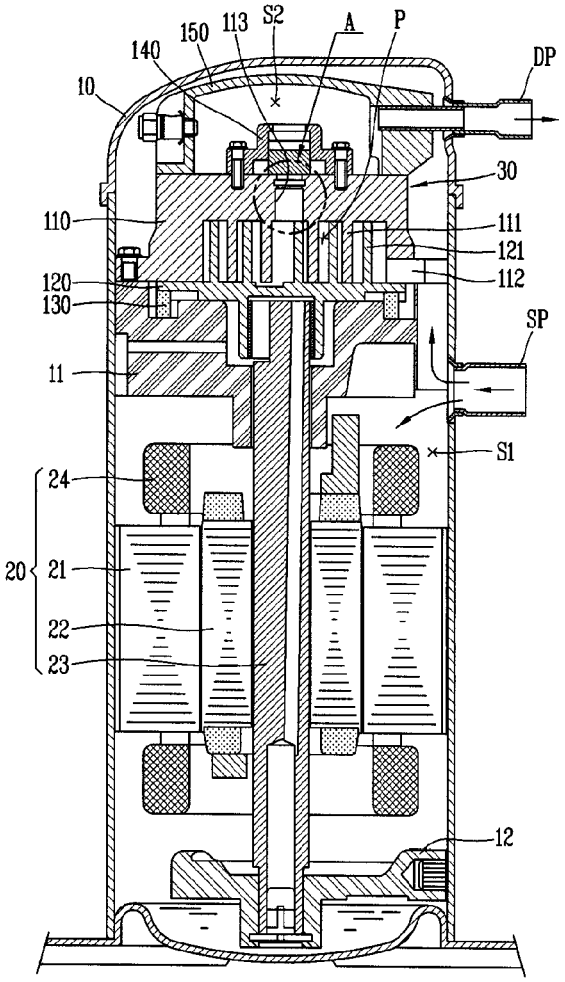
FIG. 1 is a longitudinal section view showing a scroll compressor according to a first embodiment of the present invention.

As shown in FIG. 1, the scroll compressor of the present invention comprises a casing 10 to which a suction pipe (SP) and a discharge pipe (DP) are connected, a driving motor 20 disposed at a lower side of the casing 10 for generating a rotation force, and a compression unit 30 disposed at an upper side of the casing 10 for compressing a refrigerant by receiving a rotation force generated from the driving motor 20.

The driving motor 20 includes a stator 21 fixed into the casing 10, a rotor 22 rotatably disposed in the stator 21, and a rotation shaft 23 forcibly inserted into the rotor 22 for transmitting a rotation force to the orbiting scroll 120. A coil 24 for forming a magnetic flux by receiving power from outside is wound on the stator 21. And, a conductor (not shown) for forming a magnetic flux together with the coil 24 is inserted into the rotor 22.

The compression unit 30 includes a fixed scroll 110 fixed to an upper surface of a main frame 11 fixed to the casing 10, and having a fixed wrap 111 at a bottom surface thereof; an orbiting scroll 120 orbitably disposed on an upper surface of the main frame 11, and having an orbiting wrap 121 engaged with the fixed wrap 111 of the fixed scroll 110 to form a plurality of compression chambers (P); an Oldham's ring 130 disposed between the orbiting scroll 120 and the main frame 11, for orbiting the orbiting scroll 120 with preventing the orbiting scroll 120 from rotating; a backflow preventing valve 140 for opening and closing a discharge port 113 of the fixed scroll 110; and a discharge plenum 150 fixed onto an upper surface of the fixed scroll 110.

Here, the discharge plenum 150 serves as a noise attenuating member having a discharge space (S2), a noise space so as to attenuate discharge noise occurring when a refrigerant compressed in the compression chamber (P) is discharged.

The fixed scroll 110 is provided with the fixed wrap 111 at a central part of a bottom surface of its plate portion. And, a suction port 112 is formed at one side of the bottom surface of the plate portion so that the compression chamber (P) can be communicated with a suction space (S1) of the casing 10. The discharge port 113 is formed at a central part of an upper side of the plate portion so that a discharge side of the compression chamber (P) can be communicated with a discharge space (S2) of the discharge plenum 150. The fixed wrap 111 is formed in an involute curve based on a predetermined basic circle having a radius.

The orbiting wrap 121 of the orbiting scroll 120 is formed, on an upper surface of the plate portion, in an involute shape based on a predetermined basic circle having a radius. And, the orbiting wrap 121 is formed to have the same length as the fixed wrap 111 so as to be symmetrical with the fixed wrap 111.

Figure 2:
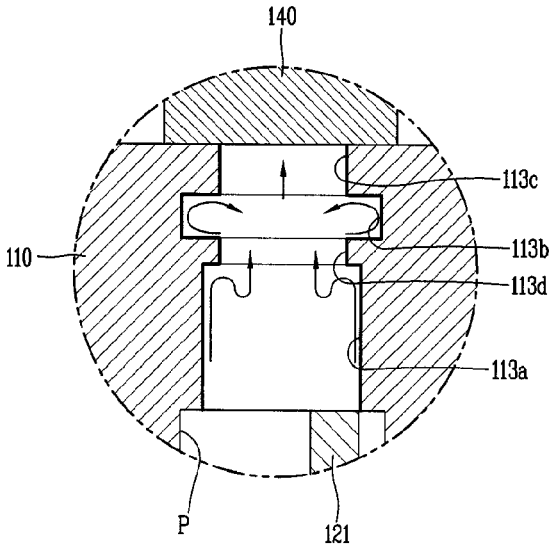
FIG. 2 is a longitudinal section view of a part, A of the scroll compressor of FIG. 1, which is shown with enlargement.
Figure 3:
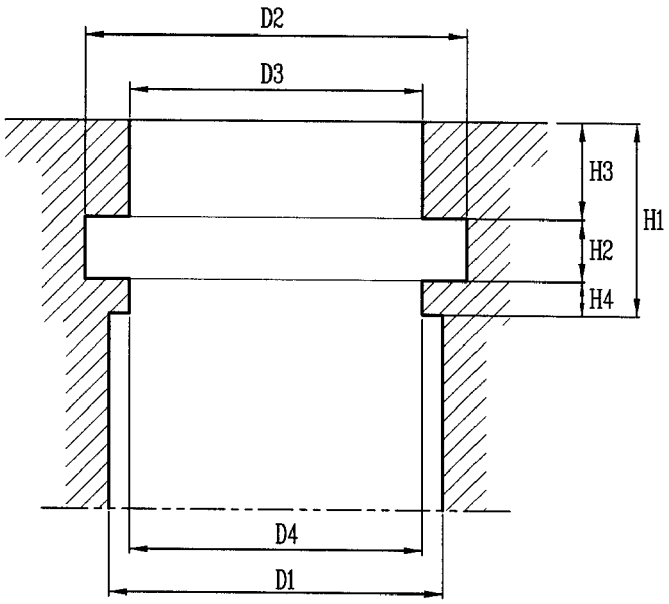
FIG. 3 is a view schematically showing a specification of a discharge port of the scroll compressor of FIG. 1.

The discharge port 113 of the fixed scroll 110 is provided with a buffer portion of which diameter is increased at an intermediate part thereof. For instance, as shown in FIGS. 2 and 3, the discharge port 113 is composed of an entrance portion 113*a* contacting a final compression chamber, a buffer portion 113*b* having a diameter increased from an outlet of the entrance portion 113*a*, and an exit portion 113*c* having a diameter decreased from an outlet of the buffer portion 113*b* to an outlet of the discharge port 113. A damping protrusion 113*d* protruding to have a diameter smaller than those of the entrance portion 113*a* and the buffer portion 113*b* is further provided between an inlet of the entrance portion 113*a* and an inlet of the buffer portion 113*b*.

A diameter (D1) of the entrance portion 113*a* is larger than a diameter (D3) of the exit portion 113*c* or a diameter (D4) of the damping protrusion 113*d*, but is smaller than a diameter (D2) of the buffer portion 113*b*. It is also possible that the diameter (D1) of the entrance portion 113*a* is equal to the diameter (D2) of the buffer portion 113*b*.

The diameter (D2) of the buffer portion 113*b* is formed to be larger than the diameter (D3) of the exit portion 113*c* or a diameter (D4) of the damping protrusion 113*d*. It is also possible that the diameter (D2) of the buffer portion 113*b* is about 1.2~1.5 times the diameter (D3) of the exit portion 113*c*.

The diameter (D3) of the exit portion 113*c* is smaller than the diameter (D4) of the damping protrusion 113*d*. However, the diameter (D3) of the exit portion 113*c* may be equal to the diameter (D4) of the damping protrusion 113*d*.

In order to enhance effects of the buffer portion 113*b*, a total length (H1) obtained by adding a length (H2) of the buffer portion 113*b*, a length (H3) of the exit portion 113*c*, and a length (H4) of the damping protrusion 113*d* to one another may be formed not to exceed a value, two times of the H2. That is, the total length (H1) may be formed to be within the range of H1=2*H2. For instance, the length (H2) of the buffer portion 113*b* may be formed to be shorter than the length (H3) of the exit portion 113*c*, but longer than the length (H4) of the damping protrusion 113*d*.

Unexplained reference numeral 12 denotes a sub-frame.

The operation of the scroll compressor according to the present invention will be explained.

Once power is supplied to the driving motor 20, the orbiting scroll 120 having received a rotation force from the driving motor 20 performs an orbiting motion on an upper surface of the main frame 11 by an eccentric distance. While the orbiting scroll 120 performs an orbiting motion, one pair of compression chambers (P) that consecutively move are formed between the fixed wrap 111 of the fixed scroll 110 and the orbiting wrap 121 of the orbiting scroll 120. The compression chambers (P) have a decreased volume while moving toward a center of the scroll compressor by the orbiting motion of the orbiting scroll 120, thereby compressing a refrigerant sucked through the suction pipe (SP). The refrigerant compressed in the compression chambers (P) is discharged out through the discharge port 113 at the final compression chamber. Then, the refrigerant passes through the discharge plenum 150, and moves to a refrigeration system through the discharge pipe (DP).

Here, the discharge port 113 is not formed to have the same diameter, but is further provided with the buffer portion 113*b* having an increased diameter at an intermediate part thereof. Accordingly, a refrigerant discharged from the final compression chamber is introduced, via the entrance portion 113*a*, into the buffer portion 113*b* having a diameter larger than that of the entrance portion 113*a*. Then, the refrigerant temporarily stays at the buffer portion 113*b*, thereby reducing a pulsating pressure. More concretely, since the diameter (D2) of the buffer portion 113*b* is larger than the diameter (D1) of the entrance portion 113*a*, or the diameter (D3) of the exit portion 113*c*, the buffer portion 113*b* forms a kind of buffer space. Accordingly, a refrigerant introduced into the buffer portion 113*b* via the entrance portion 113*a* temporarily stays at the buffer portion 113*b*, thereby reducing a sine curve. Accordingly, vibration increase due to a pulsating pressure is prevented, and thus noise of a discharge refrigerant can be more reduced at the discharge plenum 150.

Figure 4:
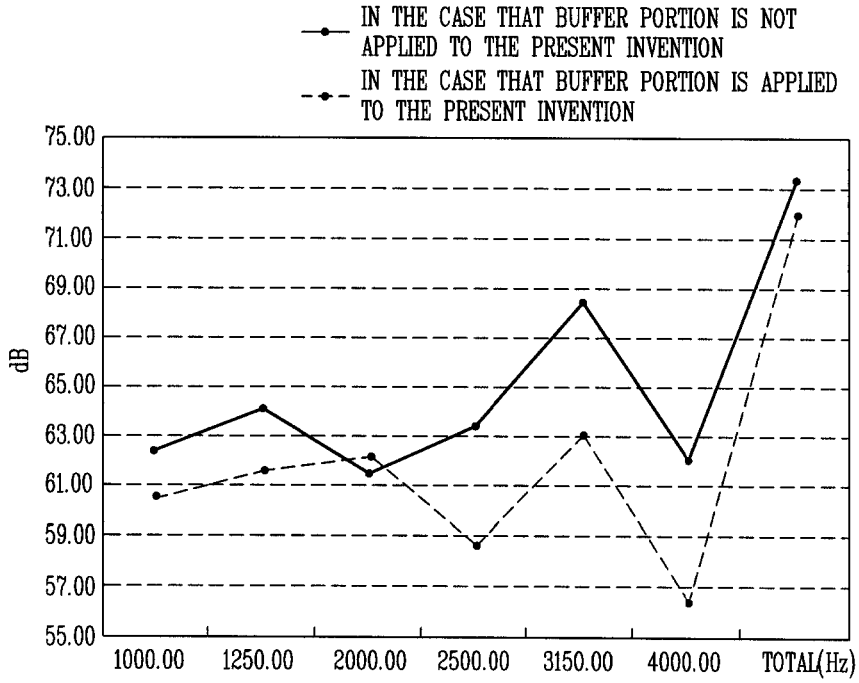
FIG. 4 is a graph comparing a noise level when the discharge port of the scroll compressor of FIG. 1 is provided with a buffer portion, with a noise level when the discharge port is provided with no buffer portion.

FIG. 4 is a graph comparing a noise level when the discharge port of the scroll compressor of FIG. 1 is provided with the buffer portion 113*b*, with a noise level when the discharge port is not provided with the buffer portion 113*b*.

Referring to FIG. 4, a large peak noise occurs near 3~4 KHz of the scroll compressor having no buffer portion, whereas the large peak noise is decreased in the scroll compressor having the buffer portion 113*b* applied thereto.

In the case that the damping protrusion 113*d* is formed between an inlet of the entrance portion 113*a* and an inlet of the buffer portion 113*b*, the damping protrusion 113*d* serving as an orifice reduces a pressure of a discharge refrigerant. Accordingly, the discharge refrigerant can stay at the buffer portion 113*b* for a long time, thereby more reducing noise of the scroll compressor.

Figure 5:
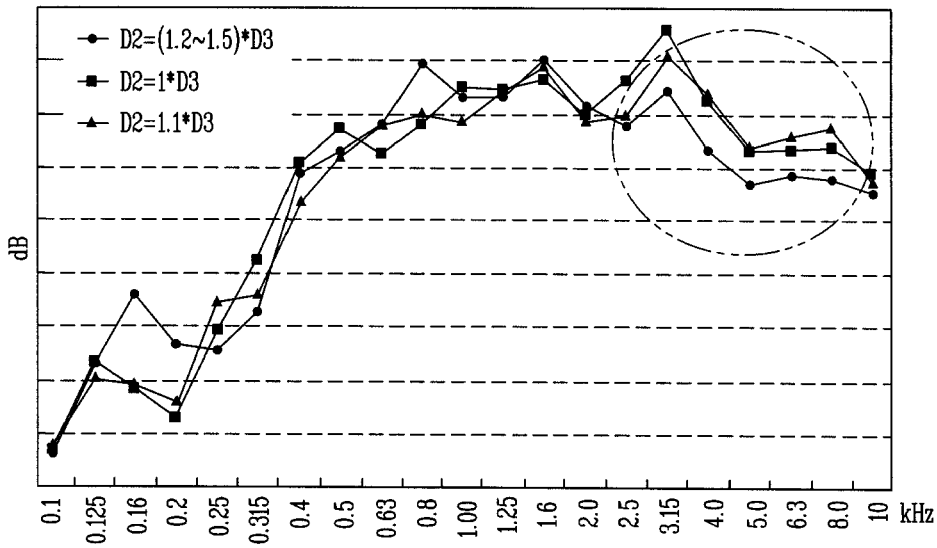
FIG. 5 is a graph comparing a noise level when the buffer portion is within a range of a predetermined specification, with a noise level when the buffer portion is not within a range of the predetermined specification.

FIG. 5 is a graph comparing a noise level when the buffer portion 113*b* is within a range of a predetermined specification, with a noise level when the buffer portion 113*b* is not within a range of the predetermined specification.

As shown in FIG. 5, when the buffer portion 113*b* is within the aforementioned range of (1.2~1.5)*D3, noise is more effectively reduced at a high region more than 2.5 KHz, than when the buffer portion 113*b* is within a range rather than the aforementioned range, D2=D3 or D2=1.1*D3.

MODE FOR THE INVENTION

A scroll compressor according to another embodiment of the present invention will be explained.

Figure 6:
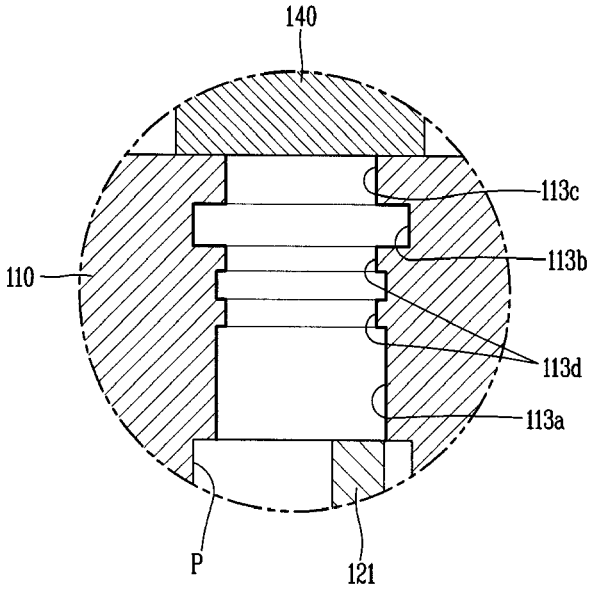
FIGS. 6 to 8 are longitudinal section views showing a buffer portion of the scroll compressor of FIG. 1 according to a second embodiment of the present invention.

In the aforementioned embodiment, one damping protrusion 113*d* is formed between an inlet of the entrance portion 113*a* and an inlet of the buffer portion 113*b*. However, in the second embodiment shown in FIG. 6, the damping protrusions 113*d* are formed in plurality in number. In this case, an excellent noise damping effect is implemented. Rather, a noise damping effect may be more anticipated due to more lowering of a pressure of a discharge refrigerant.

Figure 7:
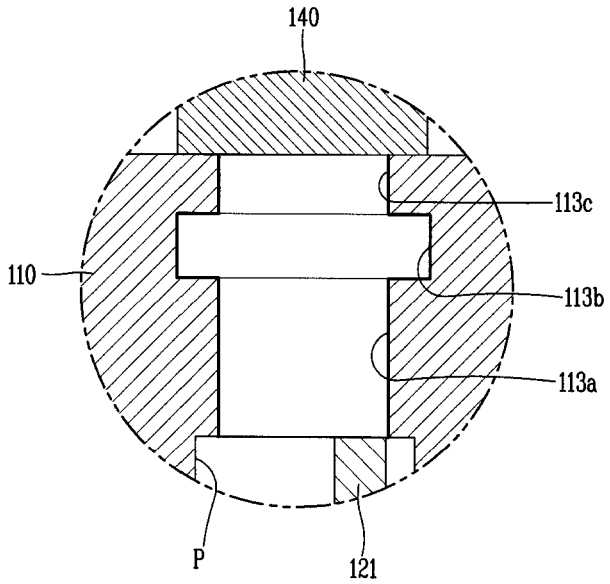

The damping protrusion 113*d* is formed in the aforementioned embodiments. However, as shown in FIG. 7, the entrance portion 113*a* and the buffer portion 113*b* may not have the damping protrusion 113*d* therebetween. In this case, since a pulsating pressure can be reduced by the buffer portion 113*b*, a noise damping effect can be also anticipated.

Figure 8:
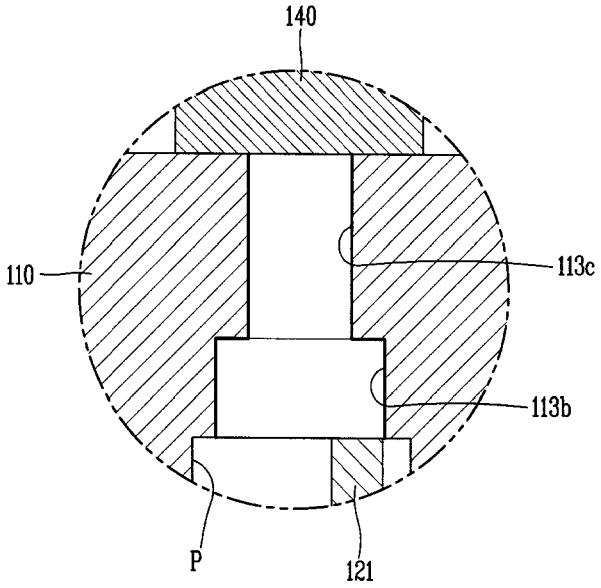

The entrance portion 113*a* is formed in the aforementioned embodiments. However, as shown in FIG. 8, the compression chambers may be directly connected to the buffer portion 113*b* not via the entrance portion 113*a*. In this case, since the exit portion 113*c* has a diameter smaller than that of the buffer portion 113*b*, a discharge refrigerant temporarily stays at the buffer portion 113*b*. Accordingly, a pulsating pressure can be reduced, and thus a noise damping effect in the scroll compressor can be anticipated.

Configurations or operation of the scroll compressor according to the second embodiment are similar to those according to the first embodiment, and thus their detailed explanations will be omitted.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

INDUSTRIAL APPLICABILITY

The scroll compressor according to the present invention aforementioned so far is a low-pressure type scroll compressor. However, the scroll compressor according to the present invention may be also applied to a high-pressure type scroll compressor. When the scroll compressor of the present invention is not provided with the discharge plenum, a discharge refrigerant may collide with the casing to cause a large noise. Accordingly, the scroll compressor of the present invention may be more effective when the discharge plenum is not provided thereat.

Furthermore, the scroll compressor of the present invention may vary the specification of the buffer portion, etc. according to a desired bandwidth for noise damping.

The invention claimed is:

1. A scroll compressor, comprising:

a fixed scroll having a fixed wrap and a discharge port;

an orbiting scroll having an orbiting wrap, wherein the fixed scroll and the orbiting scroll form compression chambers having a decreased volume as they consecutively move toward a center of the scroll compressor by being engaged with each other; and a backflow preventing valve that opens and closes the discharge port of the fixed scroll, wherein a refrigerant compressed in the compression chambers is discharged out through the discharge port, wherein the discharge port is implemented to have one or more components having different inner diameters between an entrance portion and an exit portion, wherein the discharge port includes a buffer portion between the entrance portion and the exit portion, wherein one or more damping protrusions are formed between the entrance portion and the buffer portion on an inner circumferential surface of the discharge port and extend toward a central longitudinal axis of the discharge port, wherein the buffer portion is disposed closer to the exit portion than the one or more damping protrusions, wherein a diameter of the buffer portion is larger than a diameter of the entrance portion and a diameter of the exit portion, wherein the diameter of the entrance portion is larger than the diameter of the exit portion, wherein a diameter of the one or more damping protrusions is smaller than the diameter of the entrance portion and equal to or larger than the diameter of the exit portion, and wherein a length of the buffer portion is longer than a length of each of the one or more damping protrusions.

2. The scroll compressor of claim 1, wherein the diameter of the exit portion is equal to the diameter of each of the one or more damping protrusions.

3. The scroll compressor of claim 1, wherein the diameter of the buffer portion is about 1.2~1.5 times the diameter of the exit portion.

4. The scroll compressor of claim 1, wherein a total length obtained by adding the length of the buffer portion to a length of the exit portion is equal to or less than a value which is two times the length of the buffer portion.

5. The scroll compressor of claim 1, wherein a total length obtained by adding the length of the one or more damping protrusions, the length of the buffer portion, and a length of the exit portion to one another is equal to or less than a value which is two times the length of the buffer portion.

6. The scroll compressor of claim 4, wherein the length of the buffer portion is shorter than the length of the exit portion.

7. The scroll compressor of claim 1, further comprising a noise damping member disposed on an upper surface of the fixed scroll, that accommodates the backflow preventing valve, wherein the noise damping member includes a noise damping space that accommodates the discharge port therein.

8. The scroll compressor of claim 7, wherein the noise damping member is configured to damp noise within a bandwidth of 3~4 KHz.

9. The scroll compressor of claim 1, wherein a central longitudinal axis of the one or more damping protrusions coincides with the central longitudinal axis of the discharge port.

* * * * *